United States Patent [19]

Scherer

[11] 4,194,495

[45] Mar. 25, 1980

[54] OVEN LINER AND RACK DESIGN

[75] Inventor: Richard M. Scherer, Oxford, Miss.

[73] Assignee: Chambers Corporation, Oxford, Miss.

[21] Appl. No.: 850,652

[22] Filed: Nov. 11, 1977

[51] Int. Cl.[2] ..... F24C 15/16

[52] U.S. Cl. ..... 126/339; 211/153

[58] Field of Search ..... 126/337 R, 337 A, 339, 126/19, 273; 211/153; 312/346

[56] References Cited

U.S. PATENT DOCUMENTS

| | | | |
|---|---|---|---|
| 890,861 | 6/1908 | Hogg | 126/339 |
| 1,279,612 | 9/1918 | Todd | 126/339 |
| 1,776,929 | 9/1930 | Reedy | 126/273 R |
| 1,787,022 | 12/1930 | Seeley | 126/339 |
| 1,896,307 | 2/1933 | Hatch | 126/339 |
| 1,934,125 | 11/1933 | Hurt | 126/339 |
| 2,004,024 | 6/1935 | Voorst, Jr. | 126/41 |
| 2,633,400 | 3/1953 | Ring | 312/346 |
| 3,291,113 | 12/1966 | Scott | 126/339 X |
| 3,456,966 | 7/1969 | Heinigerschar | 312/347 |
| 3,675,638 | 7/1972 | Baltz | 126/339 |
| 3,744,869 | 7/1973 | Anderson et al. | 312/330 |
| 3,977,389 | 8/1976 | Ondrasik | 126/337 R |

FOREIGN PATENT DOCUMENTS

| | | | |
|---|---|---|---|
| 839696 | 6/1960 | United Kingdom | 126/337 R |

*Primary Examiner*—Edward G. Favors

*Attorney, Agent, or Firm*—Richards, Harris & Medlock

[57] ABSTRACT

The specification discloses an over liner having canted ribs for supporting an oven rack. The parallel elongated ribs are defined by converging canted upper and lower surfaces extending from the side walls of the oven liner into the oven cavity. A series of nodes are spaced along the upper surface of each rib to support an oven rack. A shoe protrudes from the lower surface of the ribs near the forward end of the oven cavity, the shoe engaging a boss formed on guide rails on two sides of the oven rack to prevent the rack from being completely withdrawn from the oven. The oven rack is a mesh formed of parallel bar members having guide rails disposed perpendicular to the plane of the mesh along two sides thereof. Supporting surfaces are provided at an angle to the rails so that the rack may be slidably supported at an angle to the horizontal by the nodes formed on the upper surface of the ribs. A boss projecting from the lower rear portion of the guide rails engages the shoe on the lower rib surface to prevent the rack from being completely withdrawn from the oven cavity.

3 Claims, 7 Drawing Figures

OVEN LINER AND RACK DESIGN

DESCRIPTION OF THE PRIOR ART

New methods of tooling have significantly reduced both the labor and the amount of material necessary to manufacture oven liners. In one such method, for example, steel blanks are mechanically formed into a four-sided tube and dropped into a special tool where a punch expands the metal into a die to form four pairs of rack-supporting ribs along the side walls of the oven liner. Successful exploitation of this technique calls for an oven liner design in which shallow ribs are formed with converging canted surfaces.

Ovens having side walls with ribs extending therefrom and racks with cooperating arms which slide along the upper rib surface as the rack is moved into and out of the oven are well known in the art. Such structures are disclosed, for example, in U.S. Pat. Nos. 2,004,024; 1,776,929; 1,279,612 and 890,861. However, these prior designs are not adapted to be formed by the above-mentioned modern manufacturing technique. In particular, prior art designs involve rack and rib structures wherein the rack is horizontally supported by horizontal rib structure extending from the oven wall. Such prior structures have tended to mark and score the interior wall of the oven liner, as well as the horizontal rib. Moreover, such prior rib structures have not been completely satisfactory with respect to maintaining the rack in a stable solid position during movement of the rack from its extended to its retracted position.

SUMMARY OF THE INVENTION

The present invention is directed to an oven liner and oven rack design which makes the manufacture of ovens possible at substantially reduced cost of materials and labor and which provided improved oven rack operation and performance.

In accordance with the present invention, an oven liner is formed of top, bottom, rear and side walls. Pairs of elongated ribs extend from the side walls of the liner in parallel relation. Each rib is defined by converging canted upper and lower surfaces extending from the side wall of the oven liner. The upper surface defines a series of nodes spaced therealong for supporting the oven rack. Protruding from the lower surface of the rib near the forward part of the oven is a shoe which is dimensioned to engage a boss on the guide rails on the oven rack to prevent the rack from being completely withdrawn from the oven.

The oven rack consists of a mesh formed of parallel bar members. Guide rails extend perpendicularly from the mesh along two parallel sides thereof defining an inclined supporting surface whereby the rack may be slidably supported by the rib at an angle to the horizontal. A boss disposed along the lower rear portion of the guiding surfaces engages the shoe protruding from the lower surface of the ribs to prevent the rack from being completely withdrawn from the oven cavity.

DESCRIPTION OF THE DRAWINGS

For a more complete understanding of the present invention and further objects and advantages thereof, reference is now made to the following description taken in conjunction with the accompanying drawings in which.

DESCRIPTION OF THE PREFERRED EMBODIMENTS

Recent developments in the tooling of oven liners has made possible the automated manufacture of oven liners at greatly reduced cost, with a substantial savings of both labor and material.

Oven racks have been conventionally manufactured by manually making parts in a punch press, bending those parts and welding them together. Recently, however, modern semiautomated procedures have significantly reduced the amount of labor and cost of materials necessary to manufacture oven liners. In applicant's method of production, a rectangular steel blank is automatically formed into an oven liner. A mechanical apparatus lubricates the sheet, dries it, bends it into a four-sided tube, then welds a longitudinal seam of the four-sided structure. Next, the welded metal structure is manually dropped into a die tool where an eight-segment internal punch moves outward to expand the steel into a four-sided cluster, or die, stretching the metal structure to form an oven cavity having four pairs of ribs. By stretching the metal in this tool, substantially less material is needed to manufacture the liner. The rear wall of the liner is then seam-welded onto the four-sided structure, return flanging is provided for the front and piercings are made in the top.

A key problem with the present tooling approach lies in the formation of eight rack ribs. To prevent steel from locking between the ribs as the expander and die surfaces start to come together, the ribs must be relatively shallow and must have inclined smoothly converging upper and lower surfaces.

Conventional oven racks, which are horizontally supported by normal oven ribs, are impractical for oven liners with canted rib designs. Accordingly, an improved oven rack has been designed to cooperate with the inclined rib liner for this design.

Figure 1:
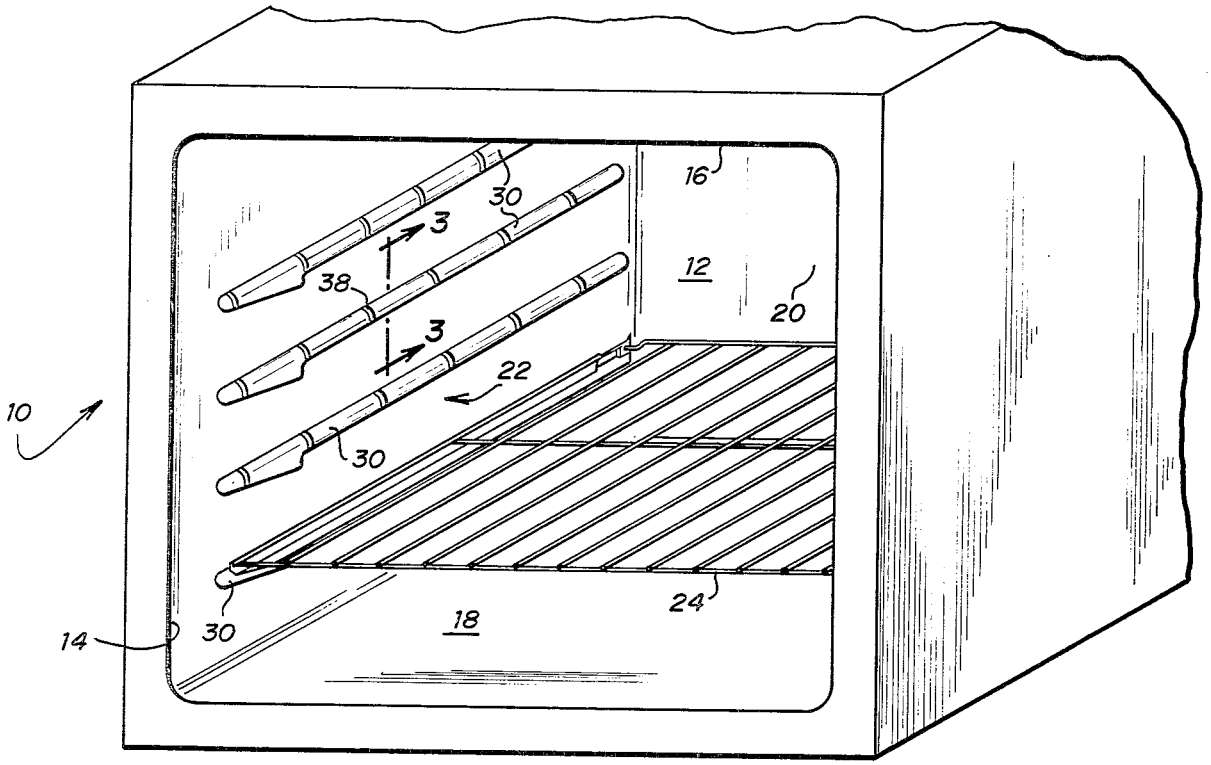
FIG. 1 is a perspective view of the oven cavity showing the oven liner, the ribs extending therefrom and the oven rack supported by the ribs.

FIG. 1 illustrates the improved oven liner and rack assembly. An oven is depicted by the numeral 10. An oven cavity 12 is formed by an oven liner 14 having a top wall 16, bottom wall 18, rear wall 20 and side walls 22. Oven liner 14 is manufactured of sheet metal steel in accordance with the above-described procedures and is coated with a suitable coating such as porcelain enamel, catalytic porcelain enamel or pyrolytic porcelain enamel.

Oven rack 24, described in greater detail hereafter, is shown supported by the lowest of ribs 30 which extend from side walls 22 and are formed in accordance with the above-described tooling process. Each of the four ribs 30 has a corresponding parallel rib extending from the opposite side wall 22 of the oven liner. A pair of ribs 30 on opposite walls define a plane parallel to the bottom wall 18 of the oven liner. Although any number of rib pairs may be formed along the side walls of the liner, four pairs of ribs are practical from the standpoint of convenience to the user.

Figure 2:
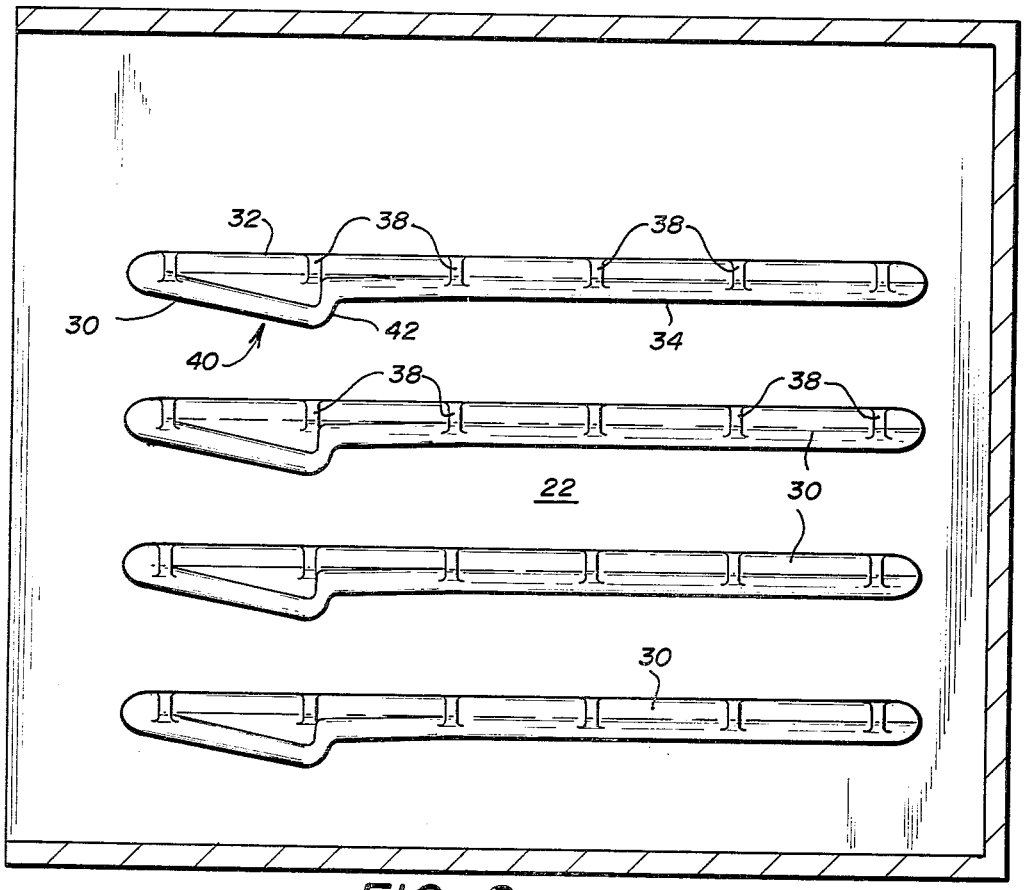
FIG. 2 is a side view of the oven liner.
Figure 3:
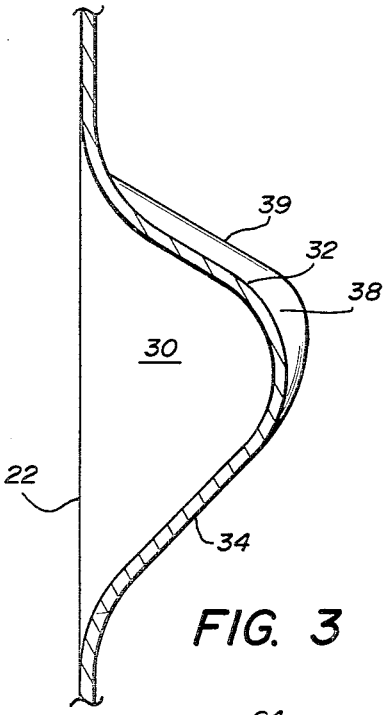
FIG. 3 is a section view of the oven liner taken along the line 3—3 in FIG. 1.

Referring now to both FIGS. 2 and 3, ribs 30 are shown to be elongated structures integral with and extending from side walls 22 in the oven cavity. Ribs 30 extend in length less than three quarters of the width of side wall 22 and extend neither completely to the front nor to the rear of the oven cavity 12. Each rib 30 is defined by an upper surface 32 and a lower surface 34, both of which extend from side wall 22 at an oblique angle. A section through rib 30 perpendicular to its length, as in FIG. 3, shows the upper and lower surfaces 32 and 34 converging in a smooth bell-shaped curve. The shallowness of the rib, about 0.335 inches, and the smoothly converging canted surfaces prevent the locking of steel in the die when the liner is manufactured by the process described above, and allow easy removal from the die.

Spaced at intervals along upper surface 32 are a plurality of nodes 38 protruding vertically upward to provide intermittent support for oven rack 24. Nodes 38 have surfaces which have the approximate contour of upper surfaces 32 and define a mating surface 39 inclined to the horizontal, as shown in FIG. 3, upon which oven rack 24 is supported. The present oven liner design utilizing relatively few support points for the oven rack whereby the rack is supported along such points at an angle to the horizontal, reduces marking and scoring of the oven liner enamel occasioned by horizontally supporting the rack along the entire length of the ribs.

As shown in FIG. 2, in the forward part of the oven near the opening to the oven cavity, a shoe 40 extends downwardly from the lower surface 34 of rib 30. Shoe 40 has a vertically inclined heel portion 42, which engages the oven rack 24, as it is being pulled from the oven, in a manner described more completely below. The forward part of shoe 40 tapers upwardly toward and merges with the lower surface 34 at the forward end of rib 30.

Figure 4:
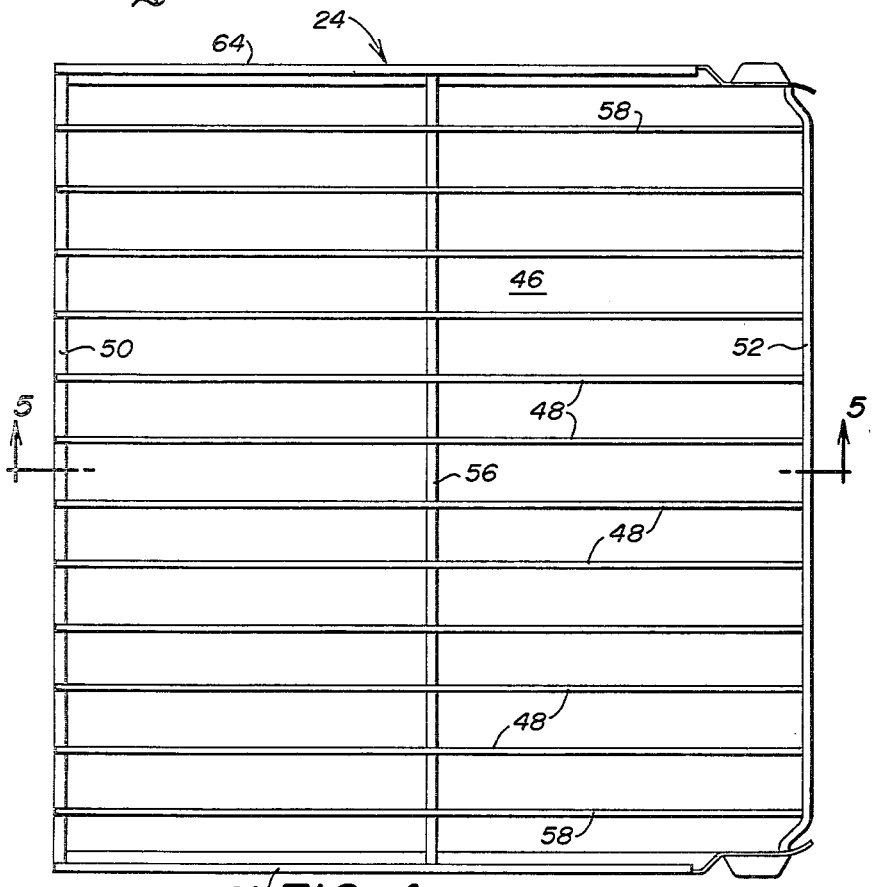
FIG. 4 is a top view of the oven rack.

Referring now to FIG. 4, oven rack 24 is defined by a rectangular mesh 46 made up of a series of parallel bar members 48, manufactured of nickel plated steel wire. Bar members 48 terminate in a front bar 50 and in a rear bar 52. A cross bar 56 disposed in the plane of the mesh, perpendicular to bar members 48, about midway across mesh 46, enhances the structural integrity of the rack. Side bars 58, which are the outermost bar members 48, support guide rails 64 disposed therealong perpendicular to the plane of the mesh 46.

Figure 5:
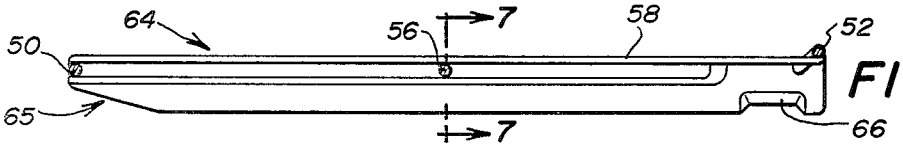
FIG. 5 is a side view of the oven rack taken along the line 5—5 in FIG. 4.

FIG. 5 shows the guide rails 64 which are mounted on side bars 58 on both sides of mesh 46. The forward portion 65 of guide rail 64, normally disposed near the openings of the oven cavity, is tapered upwardly towards side bar 58. Along the lower rear portion of guide rail 64 is formed a boss 66 which engages heel portion 42 of shoe 40 as the rack is being extended horizontally to prevent a hot oven rack from inadvertently being completely pulled from the oven cavity, causing injury. This safety feature prevents the rack from being pulled completely from the oven cavity. However, the rack is removable for cleaning by tilting the rear of the rack up so that boss 66 clears shoe 40, at which level the rack can be completely removed. While the engagement of boss 66 by shoe 40 prevents further forward movement of the oven rack, there is sufficient play in the interaction between the rack and the ribs at the point of engagement to permit vertical tilting of the front of the rack to facilitate cleaning without removing the rack from the oven.

Figure 6:
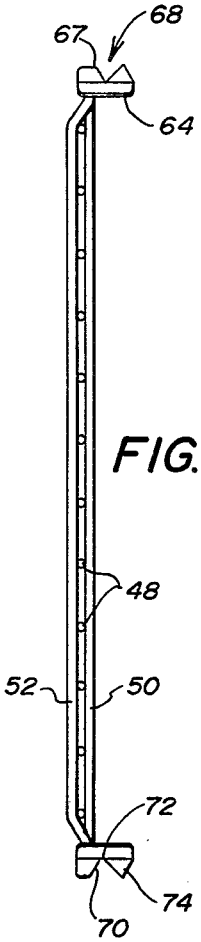
FIG. 6 is a rear view of the oven rack.

As best shown in FIG. 6 which is an end view of the rack 24, guide rail 64 extends perpendicular to mesh 46 and has inclined guiding surfaces 67 disposed on the outside thereof for engaging rib 30. Guiding surfaces 67 define an outwardly opening channel 68 wherein rib 30 is received. Guiding surfaces 67 comprise a supporting surface 70, designed to rest on mating surface 39 of the rib, a stabilizing surface 72, designed to minimize rocking of the rack on the rib, and an arresting surface 74, designed to minimize vertical movement of the rack. Guiding surfaces 67 are defined along the length of the rail from the forward edge to the region where boss 66 extends from the lower rear section of the rail.

Figure 7:
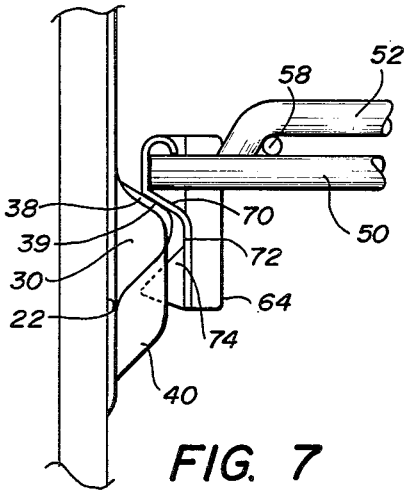
FIG. 7 is a fragmentary front view of the oven cavity showing the rack supported by the ribs.

FIG. 7 shows the oven rack supported by ribs 30 in the oven cavity. Supporting surfaces 70, which extend outwardly at an angle from guide rails 64, are supported by rib 30 along the inclined mating surface 39 on nodes 38 so that rack 24 is very stably supported along a plane inclined to the horizontal at only the few support points provided by nodes 38. Stabilizing surface 72 is substantially parallel to guide rail 64 and normally does not make contact with the rib, but is designed to abut with the rib in the event the rack undergoes lateral displacement to prevent rocking of the rack on the ribs. The increased stability provided by stabilizing surface 72 and the geometry of rib 30 and supporting surface 70 reduces the risk of spilling of the contents of pans placed on the oven rack. Further stability is provided by arresting surface 74, which extends outwardly from guide rail 64 at an angle and extends below the lower surface 34 of the ribs. While arresting surface 74 does not normally contact lower surface 34, it will abut with the lower surface to prevent vertical displacement of the rack from the rib.

While the preferred embodiment of oven rack 24 contemplates guiding rails with guiding surfaces formed of a single piece of sheet metal, other embodiments are possible which include structure manufactured completely of wire forms or structure comprising several pieces.

Although particular embodiments of the invention have been described herein, it will be understood that the invention is not limited to the embodiments disclosed, but is capable of rearrangement, modification and substitution of parts and elements without departing from the spirit of the invention.

What is claimed is:

1. For use in an oven liner of the type having canted ribs formed in the side walls thereof, the ribs being formed by relatively shallow smoothly converging upper and lower canted surfaces, an improved oven rack dimensioned to be slidably supported on the upper surface of the ribs and stabilized thereon comprising:

a mesh defined by rigidly connected substantially coplanar structural members having two substantially parallel sides;

guiding means for slidably guiding said rack into and out of the oven cavity, said means disposed substantially perpendicular to the mesh along two parallel sides thereof and including;

a supporting surface extending at an angle to the mesh for supporting the rack on the upper surface of the ribs;

a stabilizing surface disposed substantially perpendicular to the mesh, normally clear of the ribs but capable of abutting with adjacent ribs to prevent excessive lateral displacement of the rack; and an arresting surface depending at an angle from the mesh, disposed beneath and normally clear of the adjacent rib for preventing excessive vertical displacement of the rack.

2. The oven rack of claim 1 wherein said guide means includes a boss formed on the rear portion thereof dimensioned to engage the lower surface of the rib at the forward end thereof for preventing the rack from being completely withdrawn from the oven, said boss being dimensioned to clear the forward end of said rib when said rack is tilted at an angle to the horizontal to permit the rack to be withdrawn from the oven cavity.

3. An oven liner and rack assembly in which the oven liner is of the type in which the liner walls having canted ribs are formed in a die tool and in which the rack is adapted to be slidably supported and stabilized on the canted ribs formed on the side walls of the liner, the assembly comprising:

substantially perpendicular top, bottom, rear and side walls defining an oven cavity;

at least one pair of mutually parallel elongated ribs integral with said side walls, the ribs being formed by relatively shallow smoothly converging canted upper and lower surfaces extending from said side walls into the oven cavity, the upper surfaces having a plurality of nodes extending therefrom at spaced intervals for supporting a rack, each of said lower surfaces having a shoe depending from the forward portion of the rib for engaging the rack to prevent the rack from being completely withdrawn from the oven cavity;

an oven rack adapted to be slidably supported and stabilized by the nodes formed on the ribs at an angle inclined to the horizontal;

the rack having a mesh formed of substantially coplanar structural members;

guiding means for slidably guiding the rack into and out of said oven cavity, said means disposed along two opposite sides of said mesh, said means including;

a supporting surface extending from said mesh at an angle thereto for supporting the rack on said nodes at an angle to the horizontal;

a stabilizing surface being disposed substantially perpendicular to the mesh normally clear of the ribs and capable of abutting with adjacent ribs to prevent excessive lateral displacement of the rack;

arresting surface depending at an angle to the mesh disposed beneath and normally clear of the adjacent rib to prevent excessive vertical displacement of the rack; and a boss formed on the rear portion of the guiding means dimensioned to engage the shoe formed on the lower surface of each rib to prevent the rack from being completely withdrawn from the oven cavity, said boss also dimensioned to clear said shoe when the rack is tilted from the horizontal to permit withdrawal of the rack from the oven.

* * * * *

UNITED STATES PATENT AND TRADEMARK OFFICE

CERTIFICATE OF CORRECTION

PATENT NO. : 4,194,495

DATED : March 25, 1980

INVENTOR(S) : Richard M. Scherer

It is certified that error appears in the above-identified patent and that said Letters Patent are hereby corrected as shown below:

Column 1, line 38 change "provided" to --provides--.
Column 2, line 16 change "has" to --have--.
Column 3, line 52 after "46" insert --(FIG. 4)--.
Column 4, line 4 after "46" insert --(FIG. 4)--.

Signed and Sealed this

*Twenty-second* Day of *July 1980*

[SEAL]

*Attest:*

SIDNEY A. DIAMOND

*Attesting Officer*

*Commissioner of Patents and Trademarks*